US006311533B1

(12) United States Patent
Knight et al.

(10) Patent No.: US 6,311,533 B1
(45) Date of Patent: Nov. 6, 2001

(54) METHOD AND APPARATUS FOR FORMING FEATURES IN CANS

(75) Inventors: Philip John Knight; Stuart Alexander Monro, both of Oxfordshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/529,114

(22) PCT Filed: Oct. 5, 1998

(86) PCT No.: PCT/GB98/02980

§ 371 Date: Apr. 7, 2000

§ 102(e) Date: Apr. 7, 2000

(87) PCT Pub. No.: WO99/17895

PCT Pub. Date: Apr. 15, 1999

(30) Foreign Application Priority Data

Oct. 7, 1997 (GB) ..... 9721107

(51) Int. Cl.[7] ..... B21D 51/26
(52) U.S. Cl. ..... 72/92; 72/105
(58) Field of Search ..... 72/92, 93, 94, 72/105

(56) References Cited

U.S. PATENT DOCUMENTS 1,965,489 * 7/1934 Coates ..... 72/93
2,407,776 * 9/1946 Gladfelter et al. ..... 72/94
2,899,853 * 8/1959 Prutton ..... 72/93
4,578,976 4/1986 Shulski et al. .
5,150,594 * 9/1992 Pazzaglia ..... 72/92
5,349,837 9/1994 Halasz .

FOREIGN PATENT DOCUMENTS 0731740 7/1996 (EP) .
2251197 11/1991 (GB) .

* cited by examiner

*Primary Examiner*—Lowell A. Larson
(74) *Attorney, Agent, or Firm*—Diller, Ramik & Wight

(57) ABSTRACT

A method and apparatus for mechanically reshaping and/or forming textured features in the side wall of metal can bodies in which a can body is mounted on a profiled mandrel and rolled along a second mandrel or rail, which is also profiled. The tools are made from hard material but the second mandrel or rail is resiliently mounted. This mounting has been found to facilitate control of the depth of the profiled features formed in the can body. In particular, the problem of depth variability which will arise due to expansion of the machine and tooling in normal running conditions, or variability in thicknesses in the can body is avoided. Typically, the can body is clamped between complementary unformed regions on the tools during forming so as to prevent wrinkling or localised thinning of the can side wall.

14 Claims, 5 Drawing Sheets

METHOD AND APPARATUS FOR FORMING FEATURES IN CANS

BACKGROUND OF THE INVENTION

This invention relates to a method and apparatus for forming features in cans. In particular, it relates to a method and apparatus for mechanically reshaping and/or forming textured features in the side wall of metal can bodies.

It is known for example from EP-0492860 that features such as flutes can be formed in the side wall of can bodies by rolling the can, supported on a hard profiled mandrel, along a flexible rail of polyurethane. In EP-0492860, the profile of the mandrel comprises a whole number of flutes which is less than the number of flutes on the finished can body.

EP-0731740 describes another apparatus for forming grooves such as flutes in a can side wall. The apparatus of this application uses a rail having hard profiled features, the can body being carried by a mandrel of softer resilient material such as polyurethane.

EP-0492860 also describes the use of a rail and mandrel, both of which are made from hard material. The rail is fixed in position and very fine clearance and accurate matching of forming depth between the mandrel and rail must be maintained for the flutes to be formed. It is not feasible to maintain these in practice due to the increase in temperature and machine and tool expansion which occur during normal running conditions. Typically a rise of up to 40° C. is found when operating at 500 cans/minute and a temperature rise of 50° C. has been found when operating a beader at 1500 cans/minute. Since compensation for this temperature rise is not possible, damage to the machine can occur.

A roll forming apparatus such as that described in EP-0492860 uses a rotating turret to carry a number of heads comprising profiled mandrels, each of which is rotatably mounted on the turret on shafts. As the turret rotates, the can bodies located on the profiled mandrels are engaged between a profiled mandrel and a profiled rail. The shafts of the mandrels are driven so that cans mounted on the mandrels are rolled along the rail. The radial position of the mandrels on the turret is set prior to operation. However, if there is mis-setting of the heads, this will lead to variation in the depth of profiles formed on the cans which may be unacceptable to the customer.

It should be noted that temperature rise leads primarily to turret growth and subsequent change in profile depth. This in turn will result in a change in can performance. If the heads have been incorrectly set, then the problem is exacerbated still further.

Another profile commonly provided for food cans is beading. Beading typically comprises one or more clusters of circumferential beads which improve can panel performance (i.e. radial strength when subjected to external pressure) particularly during thermal processing. Beads are generally formed by rolling the can body between a rotating mandrel and a fixed rail, or a pair of rotating mandrels. Both tools are independently mounted and located on separate assemblies. However, as the temperature of the machine and tooling increases during normal operation, the depth of the beads varies and cans with unacceptable bead depths made during the warm up period may be rejected. Conventional beaders have been found to exhibit up to 0.1 mm (0.004") depth growth when hot. One beader, operating at 1500 cans/minute was found to exhibit up to 0.18 mm (0.007") depth growth.

Variation in depth on beading machines has become more of an issue as the industry is continually striving to produces thinner lightweight cans. Previously, body thickness was high enough to absorb changes in bead/profile depth resulting from poor machine settings and temperature variation. This is no longer the case.

None of the prior art documents addresses or even recognises the problem of control of the depth of the profiled features formed in the can body. In particular, the problem of depth variability which will arise due to expansion of the machine and tooling in normal running, poorly set heads, or variability in thicknesses in the can body, has not been previously been addressed. This invention seeks to provide a solution to that problem.

SUMMARY OF THE INVENTION

Accordingly, the present invention provides an apparatus for forming features in the side wall of cylindrical metal can bodies, the apparatus comprising: first and second tools formed from hard material and having complementary profiles, one of the tools being adapted to carry a can body; means for rolling the first tool relative to the second tool to deform the side wall of the can body between the tools; and a resilient mounting for the second tool for biasing the second tool towards the first.

By resiliently mounting the second tool, a series of cans may be formed with identical features of texture or shape, the features having constant depth or the same depth variations, depending on the desired profile. Unlike prior art apparatus, where the tools are independently mounted, in the present invention movement of the first tool is thus affected by movement of the resilient mounting of the second. Consistency between a series of cans, or different batches of cans can thus be guaranteed, irrespective of environmental conditions, can wall thickness, head to head variation etc. The depth is thus set by the tooling profile rather than by the relative position or spacing set between the tools as in known forming apparatus. In order that the second tool exerts a positive biasing force towards the first tool, the biasing load should exceed the forming load, i.e. the load exerted to deform the can side wall.

Usually, the tool which carries the can will be a mandrel. The other tool may be either a second mandrel or a rail. The second, resiliently mounted tool may either be provided by the tool carrying the can or by the cooperating tool in the form of a second mandrel or rail. When the second tool is a rail, this rail may be pivotally mounted. This is particularly useful since more than one can/mandrel may be on the rail at any one time.

In a preferred embodiment, each tool includes complementary unformed (unprofiled) regions such as plain edge bands between which the can body is clamped during forming. This clamping will support the can body in the unformed areas and spread the load over a larger area so as to prevent wrinkling or thinning of the can side wall. To avoid thinning in beading operations, the bead profile may also have to be adjusted. Tool to tool contact for clamping contrasts from, for example, known beaders where a gap between the tooling is always maintained so that there is no direct contact which could lead to pinching and localised thinning of the can wall.

Alternatively, in some texturing applications, where the textured features are not continuous along the length of the rail or around the circumference of the mandrel, the can body may be clamped between the tools in the regions which are not being formed.

Where clamping takes place beyond the edges of the profile only, the apparatus may further comprise means for adjusting the depth of the textured feature. Typically, this depth adjuster may comprise a spacer on a profiled rail for raising the clamped region relative to the profiled part of the rail. Where a secondary mandrel is used, a pair of rings may be used to adjust the depth. Depth adjustment may also be used to compensate for wear of tool parts.

A preferred embodiment of the invention will now be described, by way of example only, with reference to the drawings, in which:

DESCRIPTION OF THE PREFERRED EMBODIMENT

The embodiment shown in FIGS. 1 to 5 is similar to a roll forming apparatus such as that described in EP-0492860 which uses a rotating turret to roll can bodies along a profiled rail. However, in EP-0492860, where hard tooling is used both for the mandrel and the rail, a fine clearance is always set between the tools so as to avoid localised pinching of the can body between the mandrel and the rail.

In previous forming apparatus, where the profiled rail is made from flexible material such as polyurethane, the flexible rail material is locally deformed by the action of the mandrel. Soft polyurethane material has reduced operating life in comparison with hard rails and, ultimately, unwanted variations in the texture or shape of the finished can will arise.

Use of a hard mandrel and hard ("solid") rail as described in EP-0492860 requires very accurate matching of forming depth. In particular, there is nothing to compensate for temperature variation resulting in variation in the depth of features formed on the can side wall. Although the heads can be wound radially outwards, a constant tool gap cannot be maintained when the temperature of the machine and tooling increases during normal running conditions.

Figure 1:
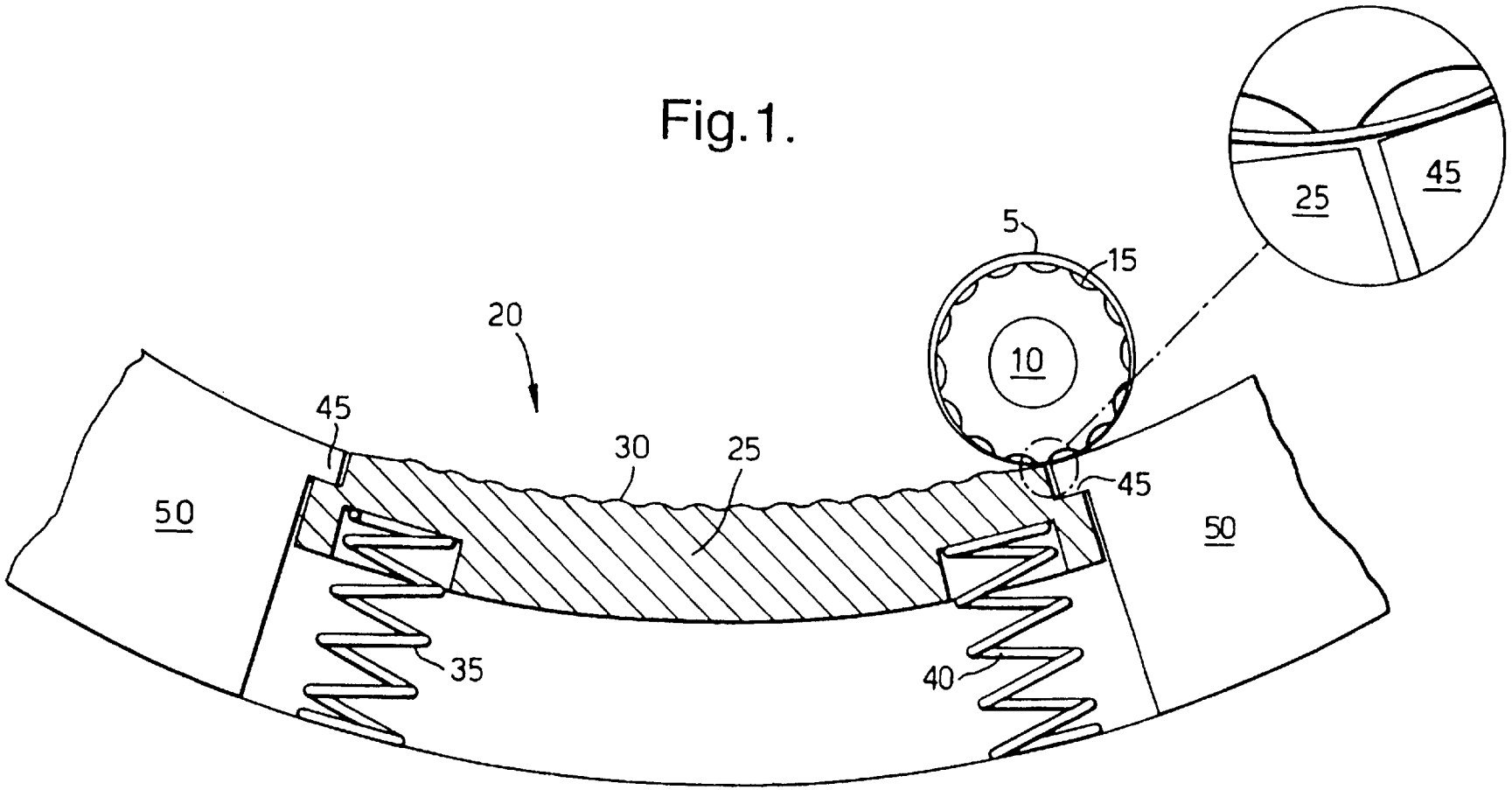
FIG. 1 is a side section of a can mounted on a mandrel moving onto a forming rail.

FIG. 1 shows a can 5 mounted on a profiled mandrel 10 and rolling onto a forming rail 20. The mandrel is made of hard material, typically metal, and has profiled flutes 15 around its circumference. The rail 20 comprises a metal layer 25 which includes profiled features, complementary in shape to those on the mandrel, on its surface 30.

In contrast with prior art roll forming apparatus, however, the forming rail 20 of FIG. 1 is resiliently mounted, for example on springs 35, 40 which bias the profiled rail outwards. Excessive outward movement of the rail is prevented by flanged stops 45 on adjacent smooth rails 50.

By using hard tooling both for the mandrel and the rail, material wear is minimised. However, in contrast with earlier apparatus, accurate matching of tool depth is not essential since the resilient mounting of the tooling of the present invention will compensate for temperature and head setting variations and will maintain desired forming depths irrespective any such changes.

Figure 2:
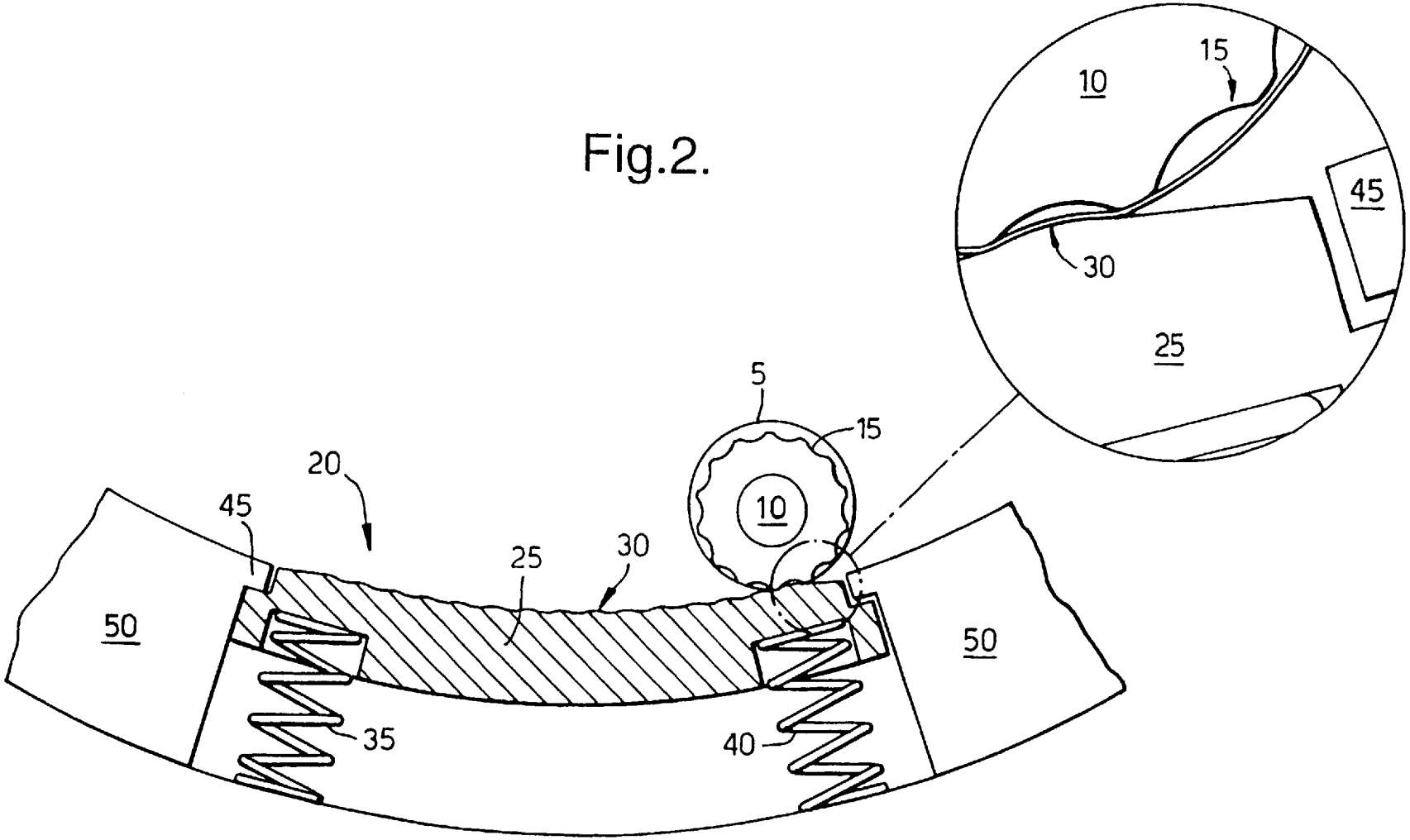
FIG. 2 is the section of FIG. 1, with the can rolling along the forming rail.

In FIG. 1, it can be seen that the forming rail 20 is pushed outwards by springs 35 and 40, the movement being limited by the stops 45. As the can and mandrel roll off the smooth rail 50 onto the forming rail, the forming rail is pushed away from stop 45 by the mandrel, and spring 40 is compressed, as shown in FIG. 2. Movement of the springs depends on any temperature change, head setting, can thickness variation and/or tooling depth variability. The provision of springs thus compensates for any of these undesirable features, even if these are within specified tolerances. It will be appreciated that in addition to resiliently mounting the rail 20 so that it can move to maintain desired forming depths around the circumference of a can (as shown in FIG. 1), the rail 20 may also be resiliently mounted so that it can move in a perpendicular direction, to maintain the desired forming depths along the length of the can.

Figure 3:
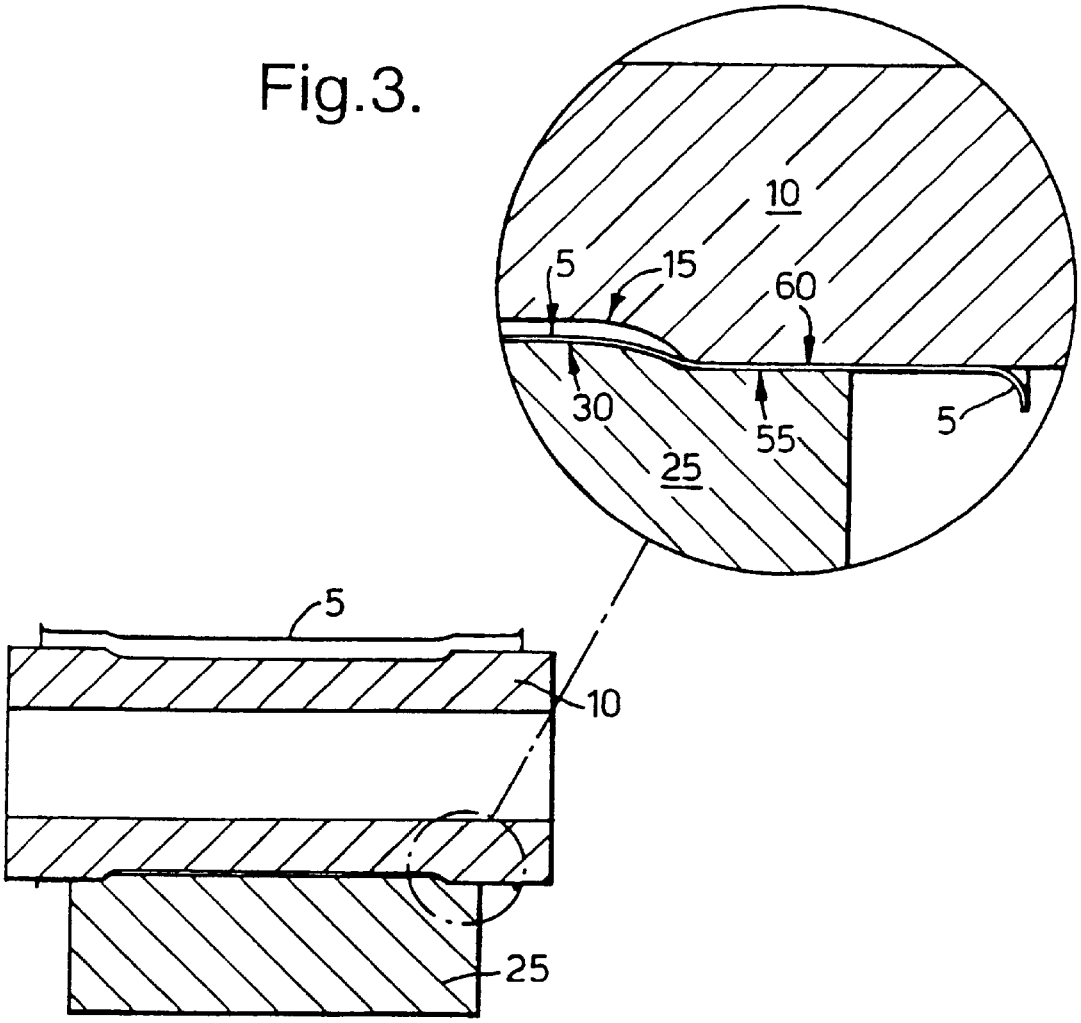
FIG. 3 is a transverse section of the rail and mandrel of FIGS. 1 and 2, showing the can clamped between the mandrel and rail.
Figure 4:
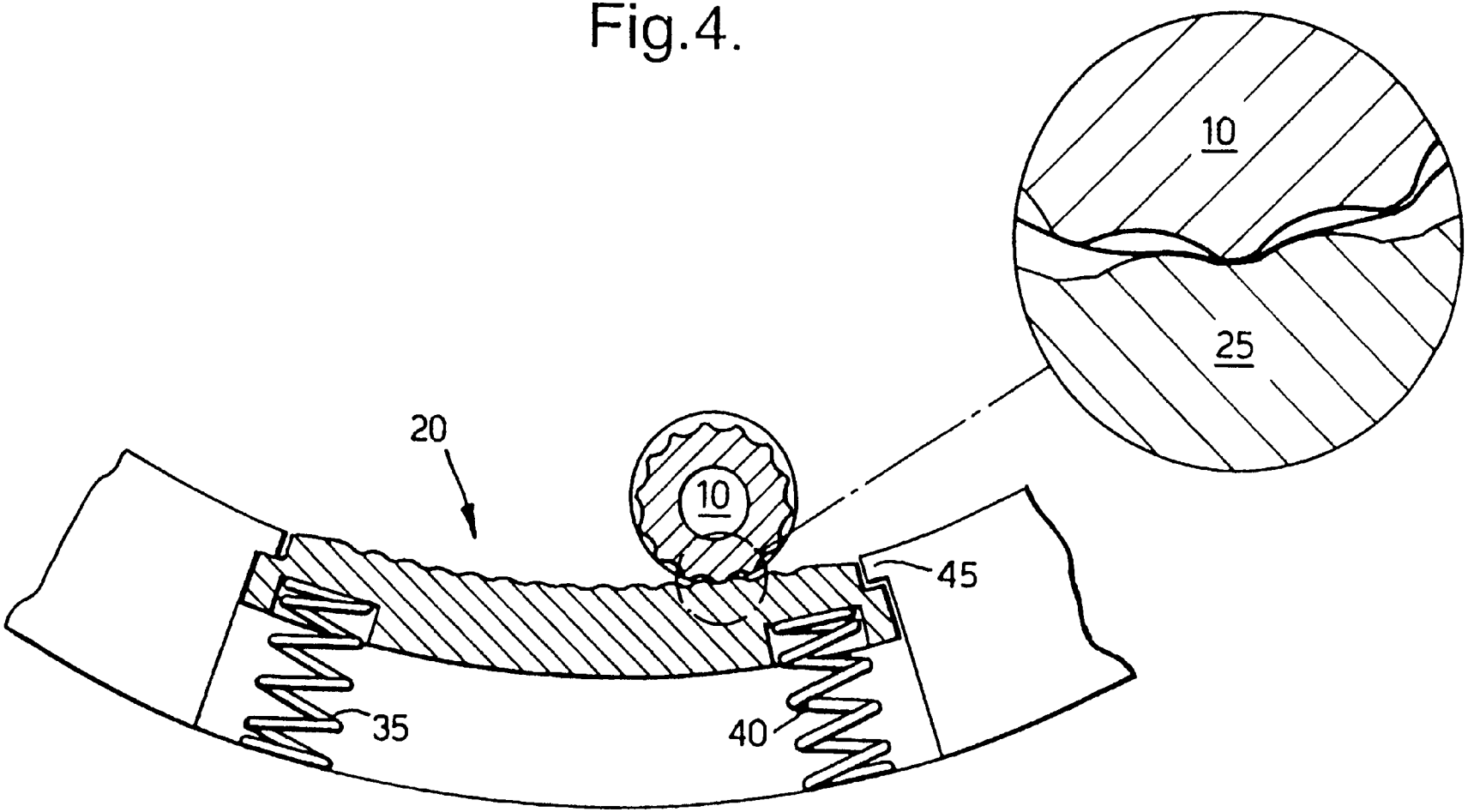
FIG. 4 is the section of FIGS. 1 and 2, showing the can clamped between the mandrel and rail.
Figure 5:
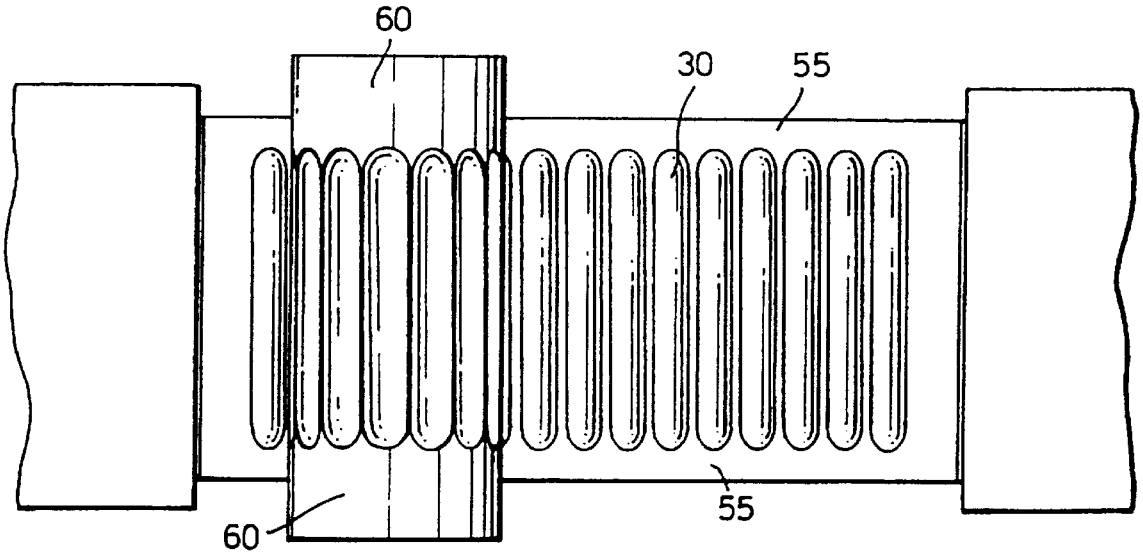
FIG. 5 is a plan view of a can on the rail of FIGS. 1 to 4.

FIGS. 3 to 5 demonstrate how localised pinching of the can body is further avoided using the apparatus of the present invention. The spring 40 is still compressed as the can and mandrel roll from right to left along the forming rail 20 as shown in FIG. 4. As is best seen in the enlarged features of FIG. 3 and 4, the profile of the mandrel 10 and metal layer 25 match in the plain regions, so that the can body is clamped along its length in these unprofiled regions between the mandrel and rail However, since there are plain regions 55, 60 either side of the fluted profiles 30, 15 on the rail and mandrel respectively, these regions will also clamp and support the can, thus preventing pinching of the can side wall.

Although in the embodiment shown, the can body is clamped between the mandrel and rail either side of the flutes as well as beyond their ends, this is not always feasible, for example for beading operations. In these circumstances, it is important to have clamping beyond the bead profile to avoid localised metal thinning and prevent depth variations.

In the embodiment shown, the profiled mandrel 10 has depressions across its surface which cooperate with projections on the rail 20, producing a can with depressions in the side wall. It will be appreciated that the mandrel 10 could equally be provided with projections across its surface, which co-operate with depressions in the rail 20, to produce a can with embossed features in the side wall. This arrangement is particularly useful for producing embossed text and external threads or lugs on a can side wall.

The embodiment shown produces a can having longitudinal flutes along its side wall. However, it will be appreciated that the tooling may also be used for a variety of other features in the can side wall such as logos, enhancing print or decoration, beading, embossing and creating thread profiles. Such features are considered to be within the scope of the invention as defined by the claims.

We claim:

1. An apparatus for forming the side wall of a substantially cylindrical can body comprising first and second tools formed from hard material and having complementary profiles, said first tool being adapted to carry a can body, means for rolling the first tool relative to the second tool for deforming the can body side wall between the tools, means for resiliently biasing the second tool toward the first tool, and said first and second tools include complementary unformed regions between which the can body side wall is clamped during forming.

2. The apparatus as claimed in claim 1 in which the first tool is a mandrel.

3. The apparatus as defined in claim 2 in which the second tool is a mandrel.

4. The apparatus as defined in claim 3 in which the complementary unformed regions are located at axially opposite ends of the first and second tools.

5. The apparatus as defined in claim 2 in which the second tool is a rail.

6. The apparatus as defined in claim 5 in which the complementary unformed regions are located at axially opposite ends of the first and second tools.

7. The apparatus as defined in claim 2 in which the second tool is a pivotally mounted rail.

8. The apparatus as defined in claim 2 in which the complementary unformed regions are located at axially opposite ends of the first and second tools.

9. The apparatus as defined in claim 1 in which the second tool is a mandrel.

10. The apparatus as defined in claim 1 in which the second tool is a rail.

11. The apparatus as defined in claim 1 in which the second tool is a pivotally mounted rail.

12. The apparatus as defined in claim 1 in which the complementary unformed regions are located at axially opposite ends of the first and second tools.

13. A method of forming the side wall of a substantially cylindrical can body comprising the steps of providing first and second tools from hard material and having complementary profiles, rolling the first and second tools relative to each other to deform the can body side wall between the tools, resiliently biasing the second tool toward the first tool, and clamping the can body at least between complementary unformed regions of the tools during forming.

14. The method as defined in claim 13 wherein the clamping takes place at axially opposite ends of the tools.

* * * * *